US009194671B1

(12) United States Patent
Song

(10) Patent No.: US 9,194,671 B1
(45) Date of Patent: Nov. 24, 2015

(54) CARBON FIBER SHEET, ARROW SHAFT, AND ARROW

(71) Applicant: Moon Jae Song, Busan (KR)

(72) Inventor: Moon Jae Song, Busan (KR)

(73) Assignee: Moon Jae Song, Busan (KR)

( * ) Notice: Subject to any disclaimer, the term of this patent is extended or adjusted under 35 U.S.C. 154(b) by 0 days.

(21) Appl. No.: 14/327,940

(22) Filed: Jul. 10, 2014

(51) Int. Cl.
*F42B 6/04* (2006.01)

(52) U.S. Cl.
CPC ..... *F42B 6/04* (2013.01)

(58) Field of Classification Search
CPC ..... F42B 6/04
See application file for complete search history.

(56) References Cited

U.S. PATENT DOCUMENTS 6,179,736 B1 * 1/2001 Thurber ..... 473/578
6,251,036 B1 * 6/2001 Wu et al. ..... 473/578
6,554,726 B2 * 4/2003 Thurber ..... 473/578
8,579,739 B2 * 11/2013 Song ..... 473/578
2003/0073524 A1 * 4/2003 Song ..... 473/578

FOREIGN PATENT DOCUMENTS

KR 10-2003-0005680 A 1/2003
KR 10-0655934 B1 8/2006
KR 10-0655951 B1 12/2006

* cited by examiner

*Primary Examiner* — John Ricci
(74) *Attorney, Agent, or Firm* — The PL Law Group, PLLC

(57) ABSTRACT

A carbon fiber sheet, an arrow shaft, and an arrow are disclosed. The arrow shaft and the arrow include a carbon fiber sheet to be formed by being wound. The carbon fiber sheet includes a plurality of carbon fiber sheet layers to be connected each other along a first direction to which the carbon fiber sheet is wound. At least one carbon fiber sheet layer of the plurality of carbon sheet layers is divided into five or more sections along a second direction perpendicular to the first direction. The five or more sections include three or more spine sections, and two or more overlapped sections which are formed between the spine sections to be overlapped with each other. The carbon fiber sheet includes a carbon fiber sheet layer that is used to manufacture the arrow shaft and the arrow.

11 Claims, 14 Drawing Sheets

PRIOR ART

CARBON FIBER SHEET, ARROW SHAFT, AND ARROW

BACKGROUND

1. Field of the Invention

The present invention relates to a carbon fiber sheet, an arrow shaft and an arrow, and in particular, relates to a carbon fiber sheet, an arrow shaft and an arrow having different spine strengths in the longitudinal direction of the arrow shaft.

2. Description of the Related Art

FIG. 1 is a schematic view of a conventional general arrow, and FIG. 2 is a conceptual view for explaining a flight phenomenon of the arrow.

An arrow 10 is generally comprised of a hollow cylindrical arrow shaft 11, an arrowhead 12 to be mounted to the front end of the arrow shaft 11, a notch 13 to be mounted to the rear end of the arrow shaft 11, and fletchings 14 to be mounted to the rear outer circumferential surface of the arrow shaft 11.

In general, an arrow leaving a bow string is subject to an impellent force which is derived from the power of the bow string pulling a rear end of the arrow. The arrow flies when the impellent force is transmitted to the front of arrow. When the arrow leaves the bow string and flies toward a target, the arrow suffers a flight phenomenon. The flight phenomenon occurs an early stage of flying shortly after leaving the bow wherein the arrow flies while shaking mainly from side to side.

In shooting an arrow, or when the arrow leaves the string, kinetic energy is momentarily transferred to the arrow. Due to such energy, the arrow is subject to bending at a pressure point and the bending dissipates to the original state of the arrow thanks to the elastic body of arrow shaft, and yet bends again in the opposite direction due to inertial energy. All the while, the arrow keeps flying while repeating such phenomena until the inertial energy is extinguished.

However, in the case of arrows for archery, the arrows are shot dozens to hundreds of times a day, so the flight phenomenon has detrimental effects on the arrow shafts. That is, as shown in FIG. 2, the arrow shaft while flying is subject to repeated bending, interchanging directions at a pressure point (i.e., center of gravity). In cases where the arrow shaft continually undergoes such a phenomenon, the arrow shaft may be subject to deformation or damage in the front or middle parts of the arrow where the center of gravity in the arrow shaft is positioned.

In order to overcome such problems, an arrow shaft was proposed with a configuration wherein a hollow aluminum tube is disposed as a core within an inner portion, and a carbon fiber sheet is laminated on the outer portion of the aluminum tube to form a double layer, then the front and rear portions of the carbon fiber sheet layer are ground with a grinding machine yielding a thicker middle portion of the arrow.

However, such an arrow product has problems wherein as the diameter of the arrow shaft is adjusted during the grinding of the carbon fiber sheet layer, it becomes difficult to manage dimensional control, the internal structure of the sheet layer is sensitive to processing defects during the grinding, and hence the arrow shaft is prone to be eccentric due to lacking exact dimensional control. In addition, it is difficult to join the aluminum core and the carbon fiber sheet layer together, and as the aluminum tube is disposed in the inner portion, the weight of the arrow shaft is increased. Further still, as the front and rear outer circumferential surfaces of the arrow shaft are ground to their required diameters, resulting in wasted material, the processing times required for machining become longer, resulting in lower productivity.

Yet further still, there is a disadvantage wherein the carbon fiber sheet layer may be peeled off or stripped off from the aluminum tube due to the impact of the arrow shaft or the different coefficients of thermal expansion between the two different materials.

As described above, the flight phenomenon occurs from the moment when the arrow is shot from the bow. At this time, if the strength, weight, and length, etc. of the arrow shaft, with respect to the strength of bow, are not appropriately considered, the arrow will not be able to fly straight.

In general, the meaning of a strong waist force is when the strength of the arrow is stronger compared to the strength of the bow (i.e., the waist force of the arrow is strong), and the meaning of a weak waist force is when the strength of the arrow is weaker compared to the strength of the bow. Therefore, in order to measure the strength of the arrow shaft, a weight is applied at the center of the arrow shaft and the amount of bending of the arrow shaft is measured. With this measurement, an arrow shaft appropriate to the strength of the bow is selected. Here, the amount of bending is in reference to the spine of the arrow.

A larger spine of the arrow shaft may provide straighter arrow flight, or less deformation of the material of which the arrow is made from caused by the frequent flight phenomenon (supra). However, the spine of the arrow must be determined in consideration of the strength of the bow. Therefore, it is not always unconditionally advantageous to make the spine larger, and furthermore, larger spines require higher material and manufacturing costs.

In addition, an arrow shaft may be subject to different external forces depending on certain positions in the longitudinal direction of the arrow shaft. More specifically, the middle portion of the arrow shaft is prone to be weakened due to the frequent bending forces caused by the above mentioned flight phenomenon, the front portion of the arrow shaft coupled with an arrowhead typically receives the most impact when the arrow strikes the target during frequent shooting, and the rear portion of the arrow shaft coupled with the notch typically receives the most impact from the string.

As described above, the arrow shaft typically receives different impact forces depending on its physical properties, size, and the respective locations along the longitudinal length of the arrow shaft. Therefore, it is necessary to differentiate elasticity, strength, or other properties in the longitudinal direction of the arrow shaft. Further, it is necessary for elasticity, strength, or other properties in the longitudinal direction of the arrow shaft to be stably secured, even though the arrow shaft may be bent due to errors in the manufacturing process and/or flight phenomenon.

SUMMARY

In view of the above, one or more embodiments of the present invention provides an arrow shaft that is formed by dividing into several parts, along the longitudinal direction of the arrow shaft, in consideration of each of the physical properties required for the arrow shaft, wherein each part differs from each other depending on their positions in the longitudinal direction of the arrow shaft, and then laminating and winding the sheets having different physical properties on each part, thereby improving the durability of the arrow shaft and optimizing the performance of the arrow shaft, such as flight stability and straightness.

Further, one or more embodiments of the present invention provides an arrow shaft in which an arrow shaft is divided into several parts along the longitudinal direction, and by applying suitable materials to largely divided parts, the strength or spine between each part is relatively differentiated, thereby optimizing the material properties of the arrow shaft without increasing additional costs.

Further, one or more embodiments of the present invention provides an arrow wherein when each of the divided parts is wound by different sheets, overlapping sections are provided between each sheet, thereby preventing errors in the strength of the arrow shaft due to the spacing apart between the different sheets caused by manufacturing tolerances or flight phenomenon.

In accordance with a first aspect of an embodiment of the present invention, provided is an arrow, which includes: a carbon fiber sheet which is wound to form the arrow shaft, the carbon fiber sheet including a plurality of carbon fiber sheet layers, each of the plurality of carbon fiber sheet layers being connected to an adjacent one of the plurality of carbon fiber sheet layers along a first direction to which the carbon fiber sheet is wound to form the arrow shaft, wherein at least one of the plurality of carbon sheet layers includes three or more sheets defining five or more sections along a second direction perpendicular to the first direction, and wherein the five or more sections include three or more spine sections, and two or more overlapped sections on each of which two adjacent sheets of the three or more sheets are overlapped.

For example, wherein the carbon fiber sheet includes a first carbon fiber sheet layer, a second carbon fiber sheet layer, and a third carbon fiber sheet layer along the first direction, and wherein the second carbon fiber sheet layer is the carbon fiber sheet layer including three or more sheets.

Further, the second direction extends from where the arrow shaft is coupled with an arrowhead to where the arrow shaft is coupled with a notch, the carbon fiber sheet layer including three or more sheets includes a first spine section, a first overlapped section, a second spine section, a second overlapped section and a third spine section along the second direction, and the first spine section and the third spine section are formed with woven carbon sheets.

Further, one spine section among three or more spine sections being defined along the second direction is formed so as to have a higher strength than any other of the spine sections.

Further, the second direction extends from where the arrow shaft is coupled with an arrowhead to where the arrow shaft is coupled with a notch, the carbon fiber sheet layer including three or more sheets includes the first spine section, the first overlapped section, the second spine section, the second overlapped section and the third spine section of which both are provided along the second direction, and an elastic strength of the second spine section is larger than those of the first spine section and the third spine section, and an area of the first and second overlapped sections are expanded as going toward the first direction.

Further, the second direction extends from where the arrow shaft is coupled with an arrowhead to where the arrow shaft is coupled with a notch, the carbon fiber sheet layer including three or more sheets includes the first spine section, the first overlapped section, the second spine section, the second overlapped section and the third spine section of which both are provided along the second direction, and at least one overlapped section of the first overlapped section and the second overlapped section is formed so as to be expanded and reduced toward the second direction, while going toward the first direction.

Further, at least one overlapped section of the first overlapped section and the second overlapped section is formed in a rhombic shape.

Further, the second direction extends from where the arrow shaft is coupled with an arrowhead to where the arrow shaft is coupled with a notch, the carbon fiber sheet layer including three or more sheets includes the first spine section, the first overlapped section, the second spine section, the second overlapped section and the third spine section of which both are provided along the second direction, and at least one overlapped section of the first overlapped section and the second overlapped section is formed so as to be expanded and reduced repeatedly toward the second direction, while going toward the first direction.

Further, the overlapped section is formed in a way that the sheet positioned in the side of the opposite direction of the second direction is positioned to be overlapped on the sheet positioned in the side of the second direction.

In accordance with a second aspect of one embodiment of the present invention, provided is an arrow, which includes an arrow shaft having any of the forgoing aspects; an arrowhead to be coupled to one side of the arrow shaft; and a notch to be coupled to the other side of the arrow shaft.

In accordance with a third aspect of one embodiment of the present invention, provided is a carbon fiber sheet which is wound to form an arrow shaft, the carbon fiber sheet including: a plurality of carbon fiber sheet layers, each of the plurality of carbon fiber sheet layers being connected to an adjacent one of the plurality of carbon fiber sheet layers along a first direction to which the carbon fiber sheet is wound to form the arrow shaft, wherein at least one of the plurality of carbon sheet layers includes three or more sheets defining five or more sections along a second direction perpendicular to the first direction, and wherein the five or more sections include three or more spine sections, and two or more overlapped sections on each of which two adjacent sheets of the three or more sheets are overlapped.

According to the embodiments of the present invention, the strength or spine required for each part depending on their position in the longitudinal direction of the arrow shaft is differentiated, and the arrow shaft is manufactured using suitable materials for sheets for each part. Therefore, the durability, flight stability, and straightness of the arrow shaft can be improved.

Further, according to the embodiments of the present invention, in order to improve the durability and the flight stability of the arrow shaft, the arrow shaft is manufactured in a way that a variety of sheets are laminated and wound on the mandrel without any separate special treatment. Therefore, the arrow shaft may be optimized for strength and durability, and may be manufactured without increasing manufacturing costs.

Further, according to the embodiments of the present invention, when each of the divided parts is wound by different sheets, overlapping sections are provided between each sheet. Therefore, the arrow shaft can be prevented from errors in the strength of the arrow shaft due to the spacing apart between the different sheets caused by manufacturing tolerances or bending via flight phenomenon.

BRIEF DESCRIPTION OF THE DRAWINGS

The features and advantages of the present invention will be more apparent from the following detailed description in conjunction with the accompanying drawings, in which.

DETAILED DESCRIPTION

Hereinafter, exemplary embodiments of the present invention will be described in detail with reference to the accompanying drawings. However, they are merely exemplary and the present invention is not limited thereto.

In the following description, well-known functions or constitutions will not be described in detail if they would unnecessarily obscure the invention. Further, the terms described below are defined in consideration of the functions of the invention and may vary depending on a user's or operator's intention or practice. Accordingly, their definitions may be made on a basis of the content throughout the specification.

The technical spirit of the present invention is determined by the appended claims, and it is to be understood to those skilled in the art that the following embodiments are a means to effectively explain the progressive technical idea of the present invention.

First, an arrow shaft according to one embodiment of the present invention will be described with reference to FIG. 3 and FIGS. 4A and 4B. As such, an arrow shaft may be formed by winding a carbon fiber sheet 100 in the direction denoted by (W) as shown in FIG. 3.

Figure 1:
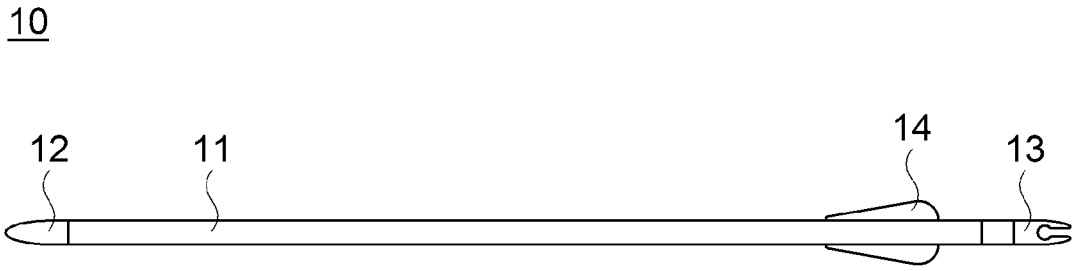
FIG. 1 is a view illustrating the shape of the arrow and the arrow shaft.
Figure 2:
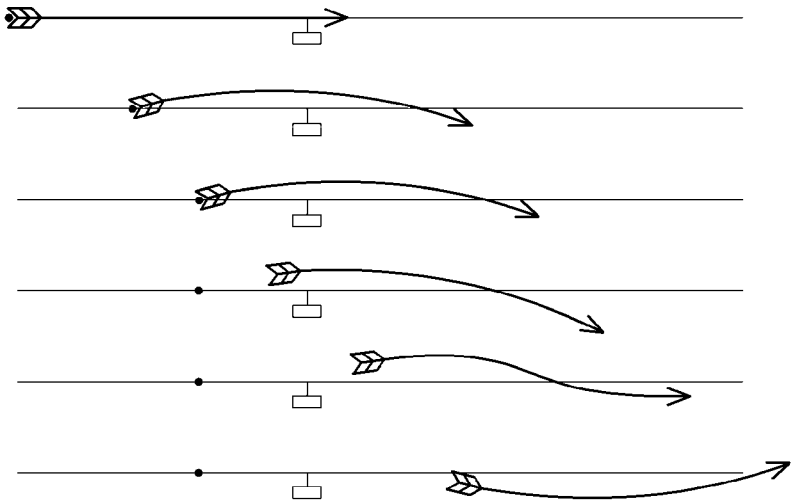
PRIOR ART FIG. 2
FIG. 2 is a view illustrating a flight phenomenon.
Figure 3:
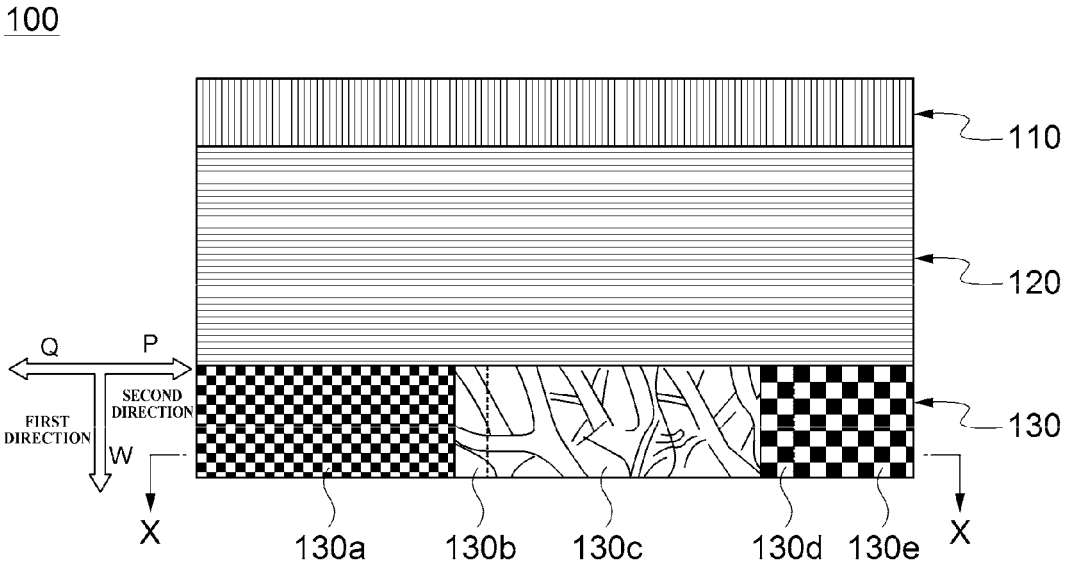
FIG. 3 is a view illustrating a carbon fiber sheet according to an embodiment of the present invention.

Specifically, the arrow shaft may be formed using the carbon fiber sheet 100 as shown in FIG. 3 through a sequence of processes including cutting, winding, taping, heat treating/cooling, core removing and grinding. Here, the carbon fiber sheet 100 may consist of an elastic sheet, such as a carbon fiber sheet or a glass fiber sheet, or in addition to the elastic sheet, may be combined with a non-elastic sheet, such as a fiber sheet, of which a camouflage pattern is treated via a printing or transferring treatment.

As shown in FIG. 3, the carbon fiber sheet 100 includes a plurality of carbon fiber sheet layers 110, 120 and 130 to be connected each other along the first direction (W) in which the carbon fiber sheet layers 110, 120 and 130 are wound to form the arrow shaft. In FIG. 3, the plurality of carbon fiber sheet layers 110, 120 and 130 are shown in three layers. Hereinafter, a detailed description of the three layers will be provided. However, the number of carbon fiber sheet layers to be provided is without limitation, and may be provided in two layers, or four or more layers as well.

The carbon fiber sheet 100 includes a first sheet layer 110, a second sheet layer 120, and a third sheet layer 130 which are wound in turn to form an arrow shaft. However, the present invention is not limited to three layers, and may include four or more sheet layers as well.

Here, the first sheet layer 110 and the second sheet layer 120 may be sheet layers in which a plurality of carbon fibers are arranged in different directions to each other. For example, the direction of their arrangement may be perpendicular to each other. That is, for example, the first sheet layer 110 may be a sheet layer in which a plurality of carbon fibers is arranged consecutively in parallel in the perpendicular direction when viewing in FIG. 3, and the second sheet layer 120 may be a sheet layer in which a plurality of carbon fibers is arranged consecutively in parallel in the horizontal direction when viewing in FIG. 3. On the contrary, although not shown in the drawing, the first sheet layer may be a sheet layer in which a plurality of carbon fibers is arranged consecutively in parallel in the horizontal direction, and the second sheet layer may be a sheet layer in which a plurality of carbon fibers is arranged consecutively in parallel in the perpendicular direction.

The third sheet layer 130 includes three sheets defining five sections along a second direction (P) perpendicular to the first direction (W). These five sections include three spine sections 130*a*, 130*c*, and 130*e*; and two overlapped sections 130*b* and 130*d* on each of which two adjacent sheets of the three or more sheets are overlapped. Of course, the third sheet layer 130 may include four or more spine sections and three or more overlapped sections as well. In cases where overlapped sections are provided in all portions adjacent to the spine sections, the number of overlapped sections to be provided may be one less than the number of spine sections. However, in cases where overlapped sections are not provided in all portions adjacent to the spine sections, the number of overlapped sections to be provided may be at least two less than the number of spine sections. Hereinafter, a description wherein the third sheet layer 130 is provided with three spine sections 130*a*, 130*c* and 130*e*, and two overlapped sections 130*b*, 130*d* of which both are arranged between the spine sections 130*a*, 130*c* and 130*e* will be provided.

In the description below, the widths of the overlapped sections 130*b*, 130*d* in the second direction (P) are illustratively exaggerated for convenience of explanation and understanding. For example, the widths of the overlapped sections 130*b*, 130*d* in the second direction (P) may be 1-2 mm.

Figure 4A:
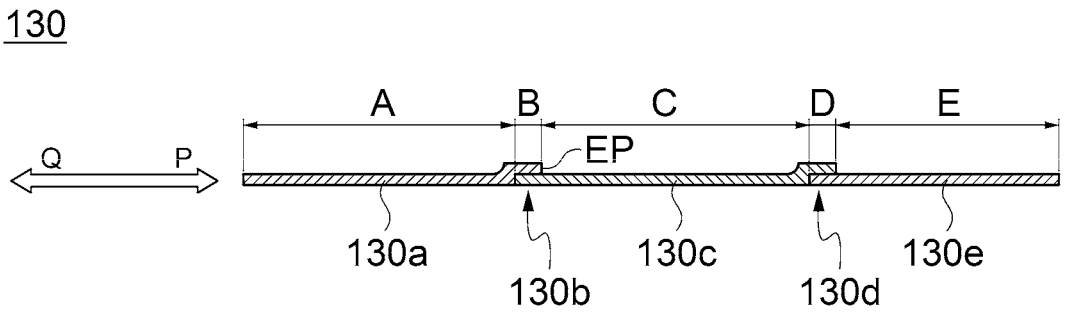
FIGS. 4A and 4B are cross-sectional views taken in the direction of X-X in FIG. 3.
Figure 4B:
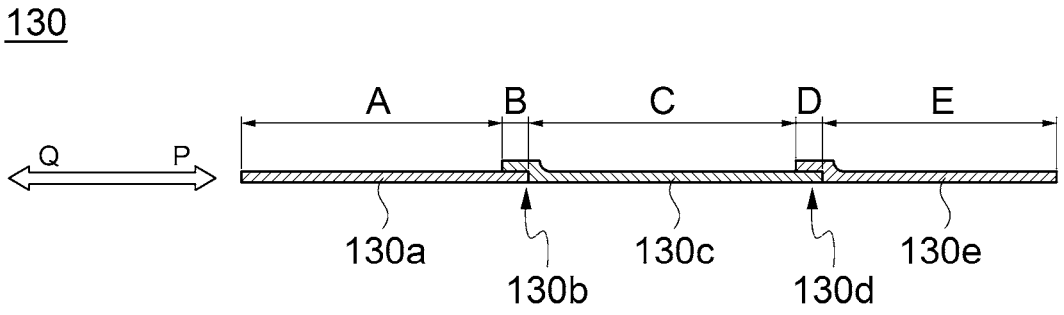

First, as shown in FIGS. 3 to 4B, the overlapped sections 130*b* and 130*d* are formed with the sheets forming spine sections 130*a*, 130*c*, and 130*e* to be overlapped. In other words, the first overlapped section 130*b* is formed by overlapping the sheet forming the first spine section 130*a* and the sheet forming the second spine section 130*c*, and the second overlapped section 130*d* is formed by overlapping the sheet forming the second spine section 130*c* and the sheet forming the third spine section 130*e*. The overlapped sections 130*b* and 130*d* are portions to be formed by overlapping the two adjacent sheets.

Here, when the sheets forming the adjacent spine sections 130*a*, 130*c*, and 130*e* are overlapped to form the overlapped sections 130*b* and 130*d*, on the basis of the overlapped sections 130*b* and 130*d*, the sheet forming the spine section positioned on the side of the second direction (P) may be located at a lower portion (i.e., the portion directed into the paper in FIG. 3, and lower portion on the paper in FIGS. 4A to 4B) of the overlapped sections 130*b* and 130*d*, and the sheet forming the spine section positioned on the side of the opposite direction (Q) of the second direction (P) may be overlapped on the spine section positioned on the side of the second direction (P). In other words, the first overlapped section 130*b* may be formed by overlapping the sheet forming the second spine section 130*c* with the sheet forming first spine section 130*a*, and the second overlapped section 130*d* may be formed by overlapping the sheet forming the third spine section 130*e* with the sheet forming the second spine section 130*c*.

As shown in FIG. 4A, the end jaw point (EP) generated by the overlapping is headed for the opposite direction compared to the direction that the product arrow is eventually shot. The arrow shaft to be formed by winding the carbon fiber sheet 100 is subject to receiving an air resistance in the opposite direction (i.e., the second direction, direction (P) in FIG. 3) compared to the direction that the arrow is shot. At this time, as the end jaw point (EP) is formed as shown, the air resistance due to the end jaw point (EP) can be minimized. However, the present invention is not limited to thereto, and in cases where the carbon fiber sheet 100 is thin enough for the air resistance not to be increased reasonably due to the end jaw point (EP), the end jaw point (EP) may be formed in the direction that the arrow is shot, as shown in FIG. 4B. Further, although not shown in the drawing, the directions of the end jaw points (EP) in each of the overlapped sections 130*b* and 130*d* may not be same as well.

When the overlapped sections 130*b* and 130*d* are formed as described above, couplings between the first spine section 130*a*, the second spine section 130*c*, and the third spine section 130*e* can be ensured.

In the course of winding the carbon fiber sheet 100 to form the arrow shaft, if the direction of the winding is not an ideal winding direction ((W) in FIG. 3) or the carbon fiber sheet 100 is not an ideal rectangular shape, it may be accompanied with unexpected errors.

In addition, the arrow shaft may experience bending during use. For example, the arrow shaft may experience bending caused by a force transferred via the notch from the string when shooting, due to flight phenomenon while flying toward the target, and by a repulsive force when the arrowhead strikes the target. Due to the variety of potential bending sources, the first spine section 130*a*, the second spine section 130*c*, and the third spine section 130*e* of the arrow shaft may experience tensions inducing those sections to be spaced apart from one another, whereby the mutual couplings may be weakened. In cases where bending results from repeated use of the arrow, the first spine section 130*a*, the second spine section 130*c* and a third spine section 130*e* may be spaced apart from one another, and therefore, the spaced-apart portions may be weakened. Thus, the arrow shaft may become prone to damage and its lifetime will be shortened.

However, the arrow shaft and the arrow according to one embodiment of the present invention are provided with overlapped sections 130*b* and 130*d* between the spine sections 130*a*, 130*c*, and 130*e*. Therefore, coupling between the first spine section 130*a*, the second spine section 130*c*, and the third spine section 130*e* can be prevented from weakening due to such bending. In other words, the overlapping sections 130*b* and 130*d* are formed by overlapping the sheets of adjacent spine sections 130*a*, 130*c* and 130*e*, thereby strengthening the coupling forces between the spine sections 130*a*, 130*c* and 130*e*. Further, as the overlapped sections 130*b* and 130*d* occupy certain portions of different areas, the portions to be coupled between the spine sections 130*a*, 130*c* and 130*e* become wider, and thus the feasibility of the adjacent spine sections 130*a*, 130*c* and 130*e* becoming spaced apart becomes extremely low. Therefore, the arrow shaft and the arrow according to one embodiment of the present invention can make the coupling between the spine sections 130*a*, 130*c*, and 130*e* be maintained even after tension caused by such bending. Here, the areas which the overlapped sections 130*b* and 130*d* occupy may be selected in consideration of an adhesive strength for coupling the spine sections 130*a*, 130*c* and 130*e* from one another, a degree of straightness of the arrow shaft, and an intended durability, etc.

In FIGS. 3 to 4B, the first spine section 130*a*, the sheet forming the second spine section 130*c* and the sheet forming the third spine section 130*e* have rectangular shapes, respectively. In light of the rectangular shapes of 130*a*, 130*c*, and 130*e*, the first overlapped section 130*b* and the second overlapped section 130*d* to be overlapped with those spine sections are illustrated to have rectangular shapes as well.

However, the overlapped sections 130*b* and 130*d* may be formed in various shapes. Further, the overlapped sections 130*b* and 130*d* may even be different shapes from each other, but, hereinafter, a description of the overlapped sections will be focused on cases wherein the overlapped sections have the same shape. However, the present invention is not limited to thereto, and each of the overlapped sections 130*b* and 130*d* may have different shapes as well by the choice of a variety of shapes to be described hereinafter.

First, the first overlapped section 130*b* and the second overlapped section 130*d* may have a shape which, while going toward the first direction (W), is expanded and reduced toward the second direction (P). By having such a shape to be expanded and reduced, the first overlapped section 130*b* and the second overlapped section 130*d* can make the coupling of the spine sections 130*a*, 130*c* and 130*e* maintained flexibly against any bending which may occur at a variety of positions in the longitudinal direction of the arrow shaft. Here, the first overlapped section 130*b* and the second overlapped section 130*d* may be formed in a shape which is expanded and reduced at one time, and also may be formed in a shape which is expanded and reduced repeatedly at two or more times.

In the first overlapped section 130*b* and the second overlapped section 130*d*, in cases where the expansion and reduction are made at one time, as shown in FIGS. 5A to 6B, the first overlapped section 130*b* and the second overlapped section 130*d* may be formed in a triangular or rhombic shape. When the sheets forming the spine sections 130*a*, 130*c* and 130*e* are overlapped for the overlapped sections 130*b* and 130*d* to be formed, the sheets positioned in the lower portion at the overlapped sections 130*b*, 130*d* may differ, which are illustrated separately in A and B of FIGS. 5 and 6, respectively. This is the same in all drawings to be described hereinafter.

Figure 5A:
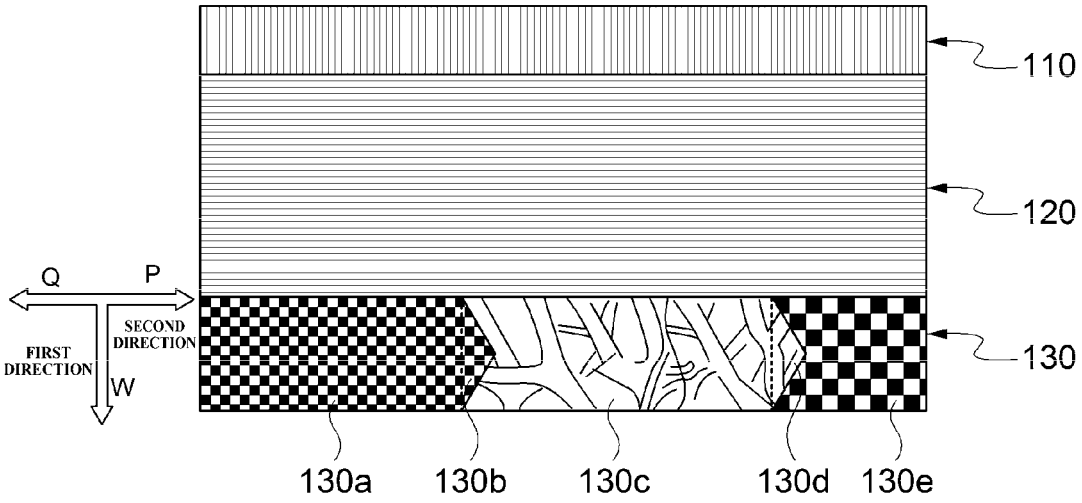
FIGS. 5A through 14B are views illustrating modified examples of carbon fiber sheets according to an embodiment of the present invention.
Figure 5B:
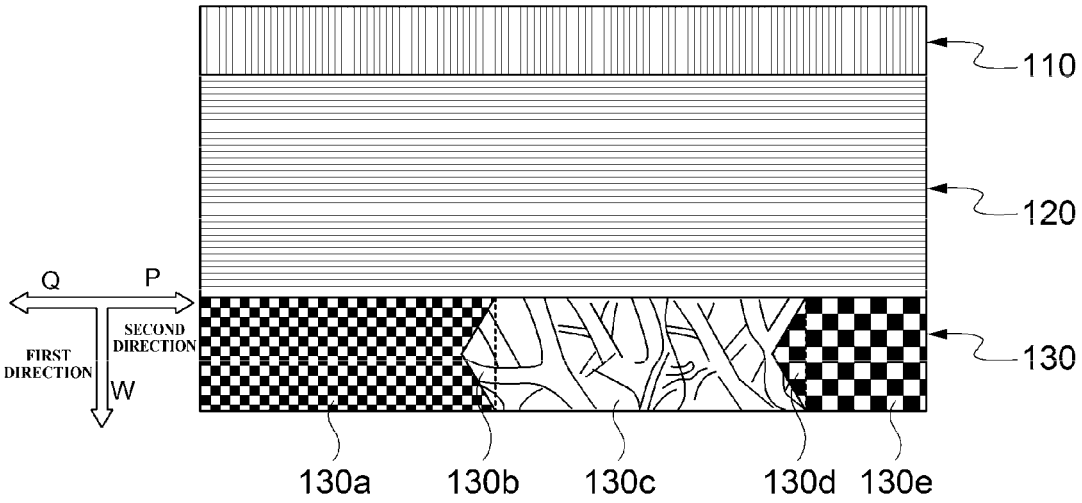
Figure 6A:
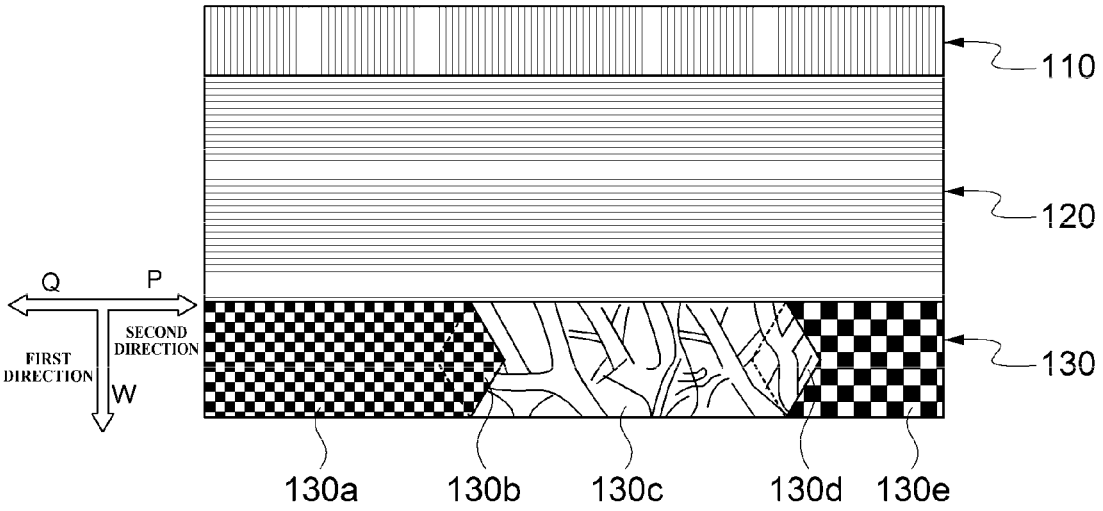
Figure 6B:
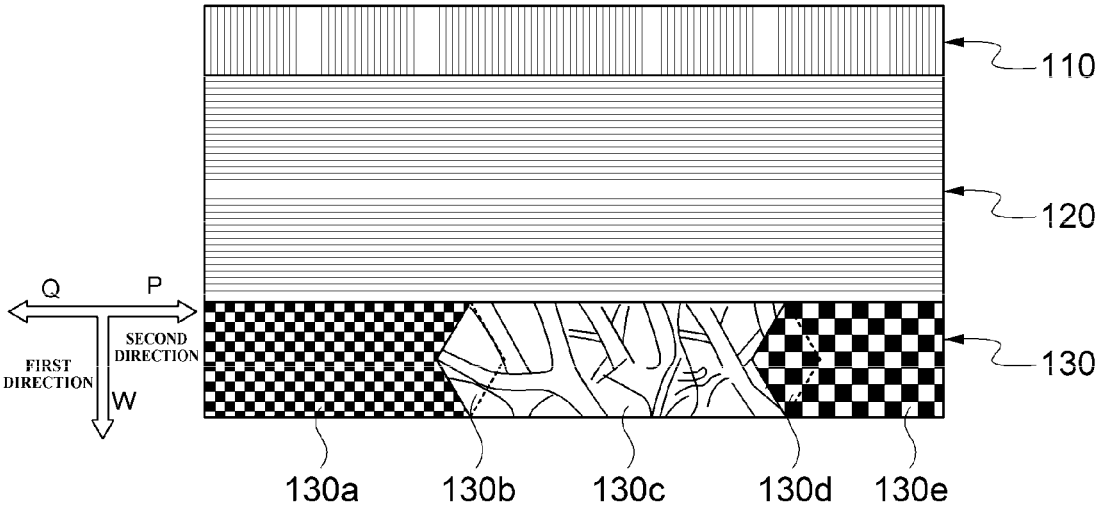

That is, as shown in FIGS. 5A to 6B, the overlapped sections 130*b* and 130*d* may be expanded and reduced at one time toward the second direction (P), while going toward the first direction (W). Here, the expansion and reduction toward the second direction (P) include a case where the overlapped sections are expanded and reduced only toward the second direction (P), and a case where the overlapped sections are expanded and reduced toward the second direction (P) as well as the opposite direction (Q). In other words, as shown in FIGS. 5A and 5B, the overlapped sections 130*b* and 130*d* may be expanded and reduced only toward the second direction (P) as triangular shapes, and may be expanded and reduced toward the second direction (P) as well as the opposite direction (Q) at the same time as rhombic shapes.

Figure 7A:
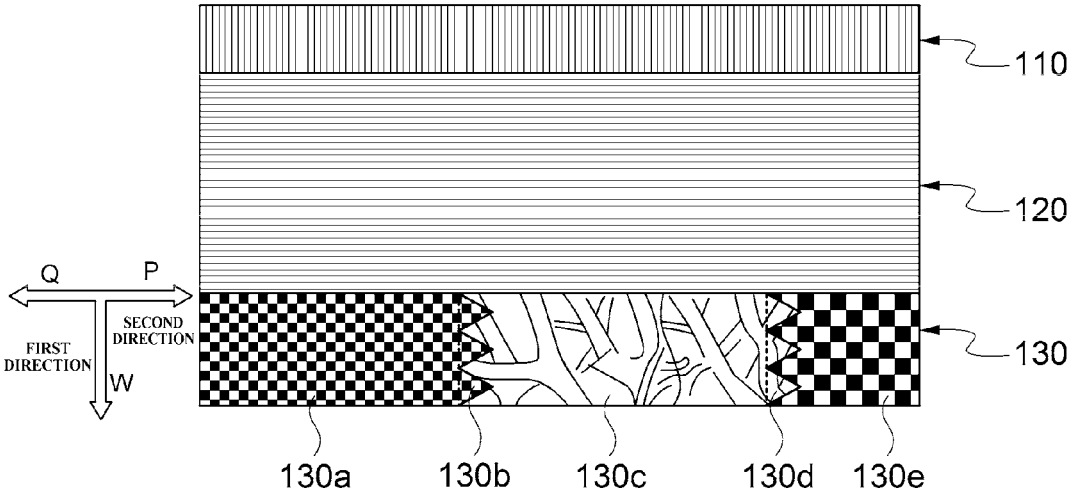
Figure 7B:
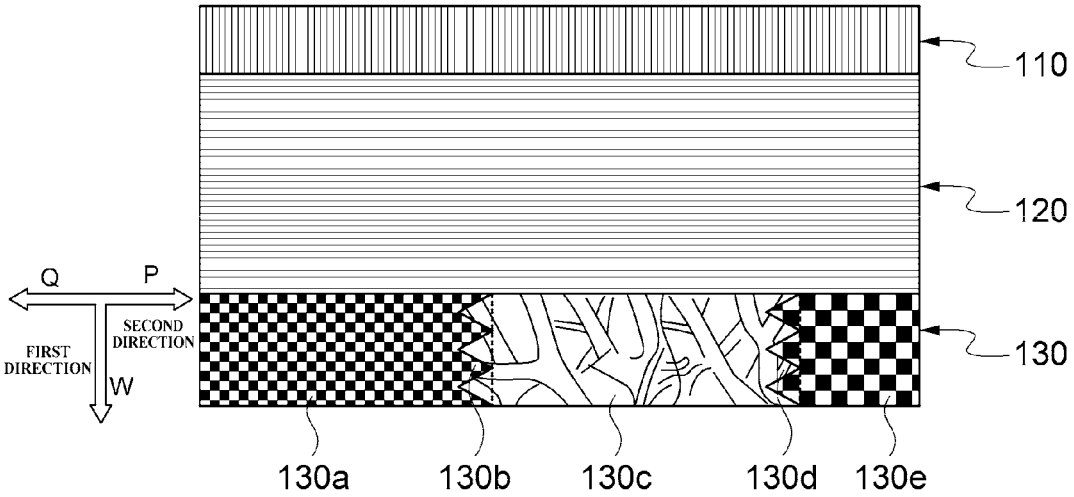
Figure 8A:
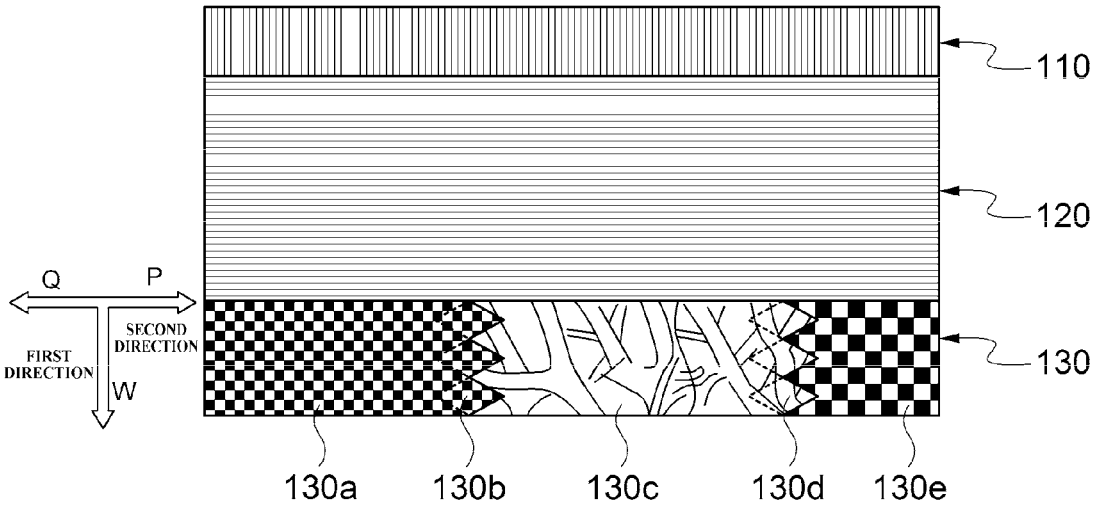
Figure 8B:
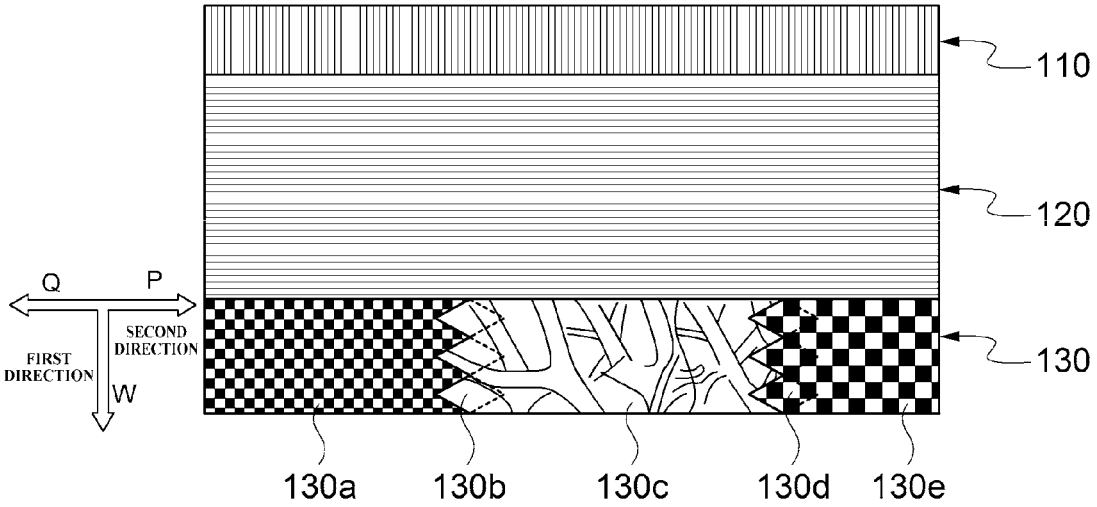

In addition, the overlapped sections 130*b* and 130*d* may be expanded and reduced at two or more times toward the second direction (P), while going toward the first direction (W). Here, the expansion and reduction toward the second direction (P) includes a case where the overlapped sections are expanded and reduced only toward the second direction (P), and a case where the overlapped sections are expanded and reduced toward the second direction (P) as well as the opposite direction (Q) at the same time. As shown in FIGS. 7A and 7B, the overlapped sections 130*b* and 130*d* may be formed in triangular shapes to be repeated while going toward the first direction (W), and may be formed in rhombic shapes to be repeated while going toward the first direction (W). As such, the overlapped sections 130*b* and 130*d* are expanded and reduced at two or more positions toward the second direction (P) while going toward the first direction (W). With this, the coupling of the spine sections 130*a*, 130*c* and 130*e* can be maintained more flexibly. Further, the aesthetics of the exterior of the arrow shaft can be enhanced, which may also raise demand.

Further, the carbon fiber sheet 100 as shown in FIGS. 3 to 4B is configured so that the overlapped sections 130*b* and 130*d* have the same width toward the direction (P) while going toward the first direction (W).

However, the overlapped sections 130*b* and 130*d* are not limited thereto, and may be formed so the width of the second direction (P) is increased toward the first direction (W). Here, the width of the second direction (P) may be increased continuously or gradationally. In addition, in cases where the width of the second direction (P) is increased continuously, the width may be increased linearly or non-linearly. Thus, in the arrow shaft to be formed by winding the carbon fiber sheet 100, the portion (i.e., the outermost portion in the radial direction of the arrow shaft) that most directly faces the bending, and is most subject to deformation due to bending, can be enhanced in coupling force.

Figure 9A:
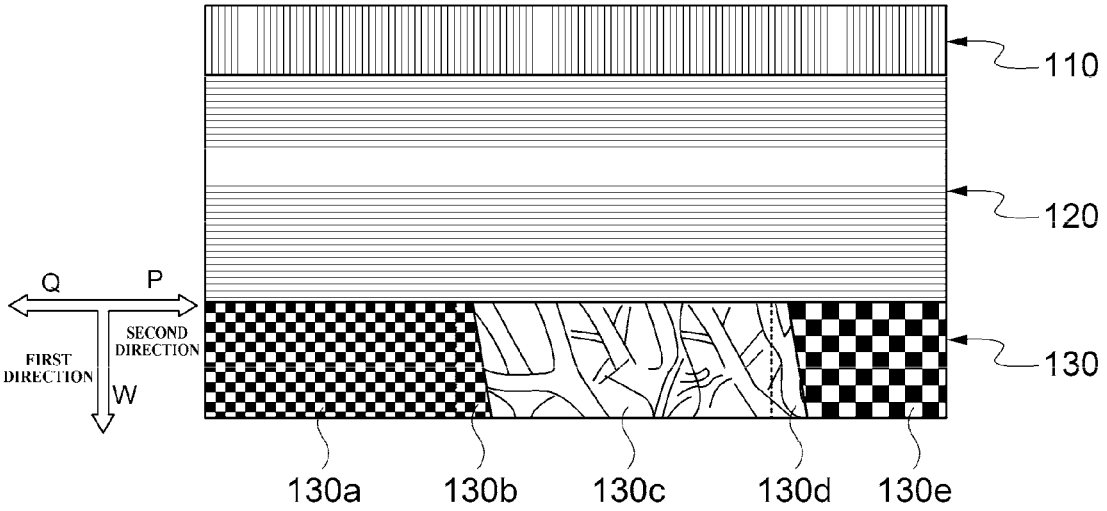
Figure 9B:
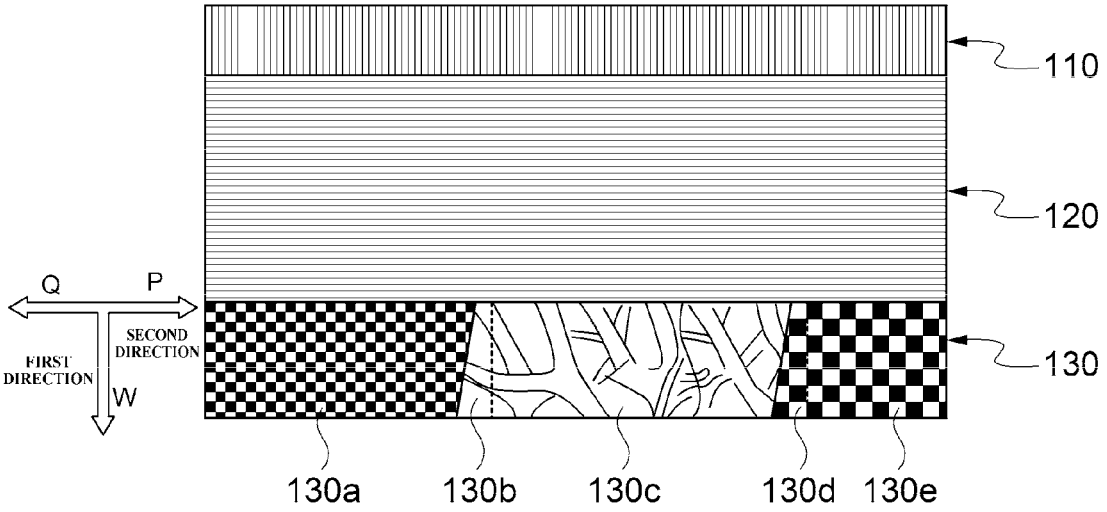
Figure 10A:
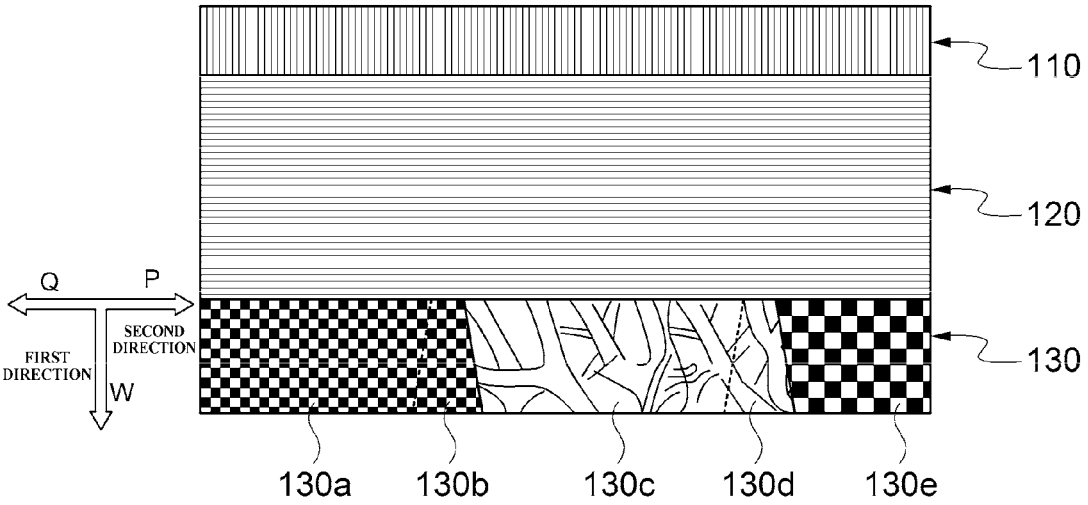
Figure 10B:
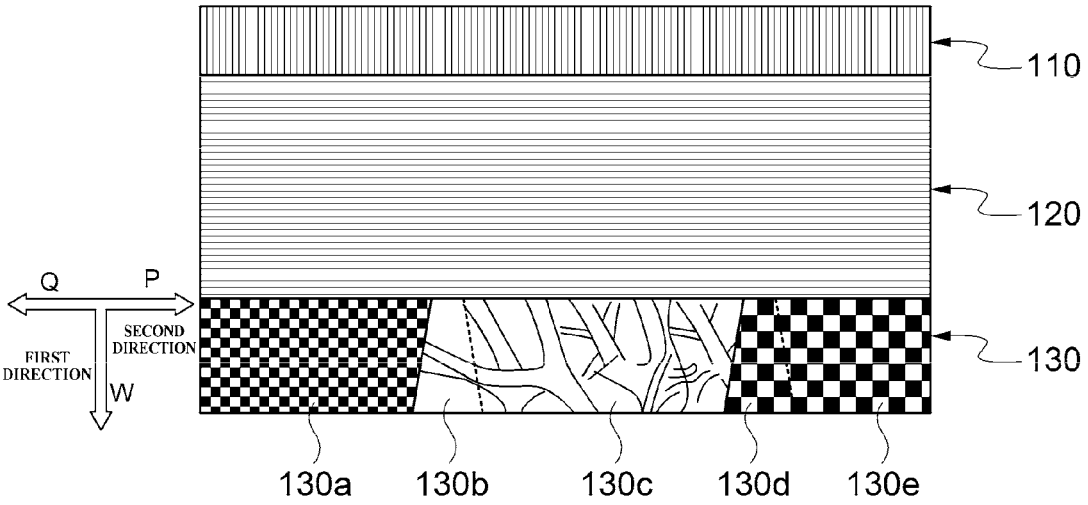

That is, as shown in FIGS. 9A to 10B, the overlapped sections 130*b* and 130*d* may be expanded linearly toward the second direction (P) while going toward the first direction (W). Here, the expansion toward the second direction (P) includes a case of expanding toward the second direction (P) line, and a case of expanding toward the second direction (P) as well as the opposite direction (Q) at the same time. In other words, as shown in FIGS. 9A and 9B, the overlapped sections 130*b* and 130*d* may be expanded toward the second direction (P) only to be formed as one half of an isosceles trapezoid shape, or may be expanded and reduced toward the second direction (P) and the opposite direction (Q) at the same time to be formed in an isosceles trapezoid shape. Although not shown in the drawing, the degree of expanding toward the second direction (P) and the opposite direction (Q) may be differentiated as well.

Figure 11A:
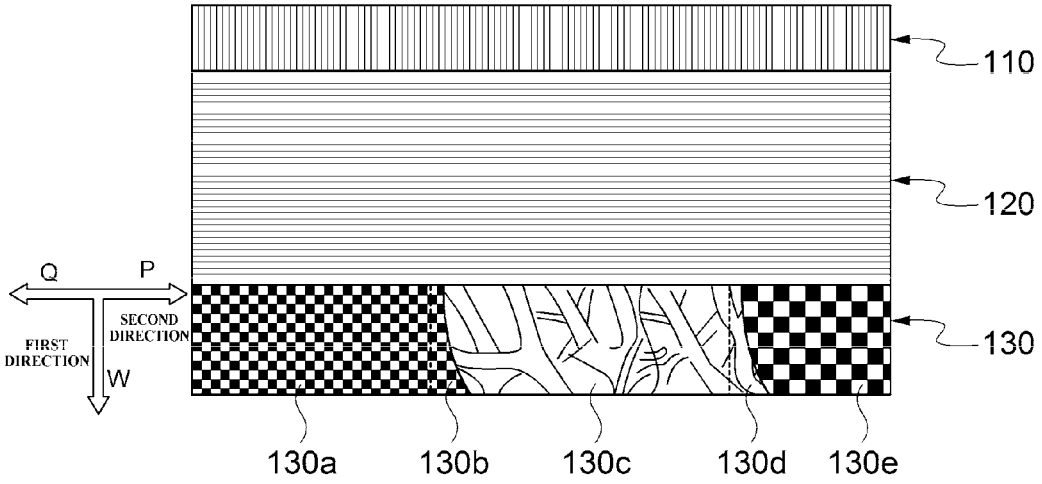
Figure 11B:
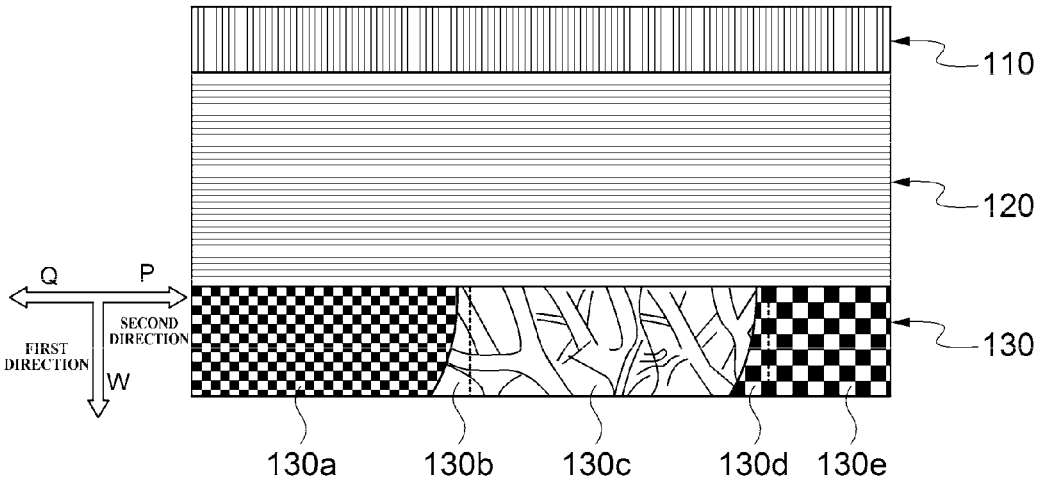
Figure 12A:
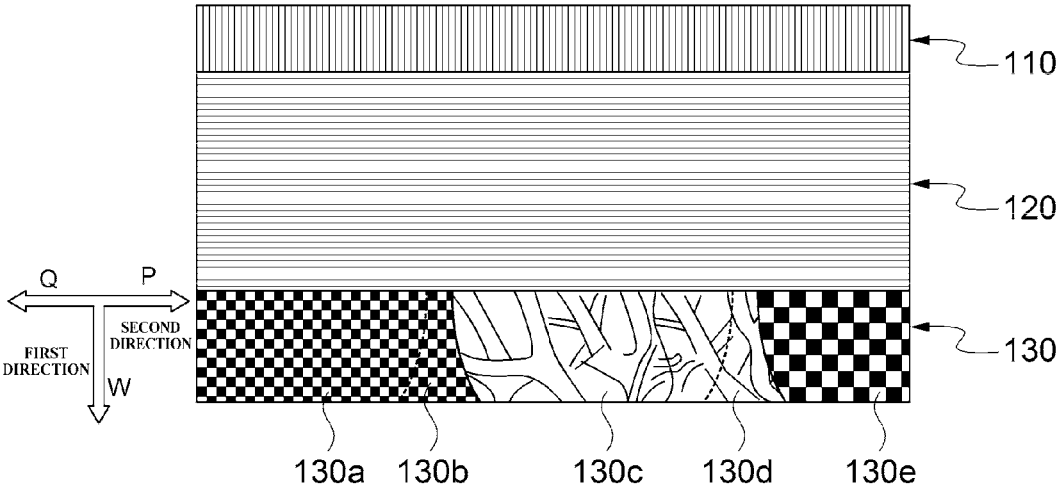
Figure 12B:
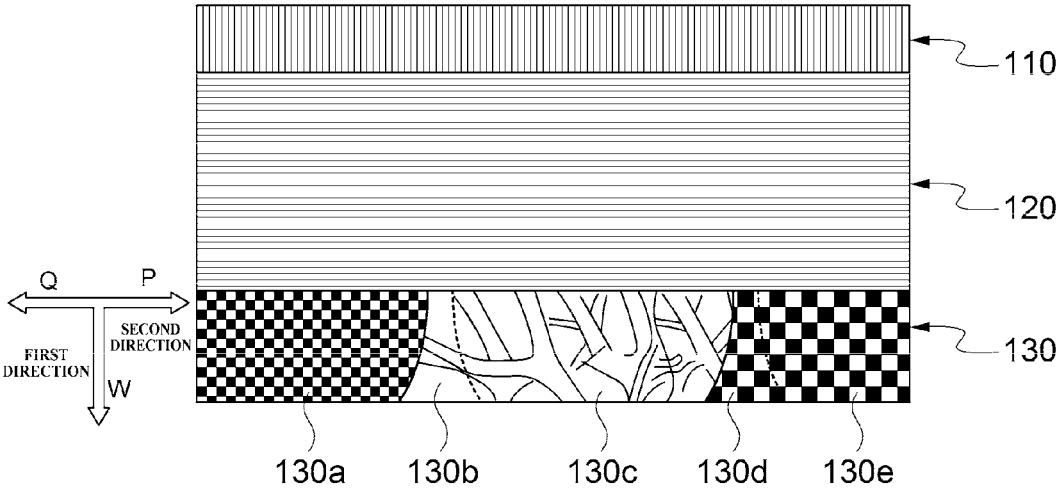
Figure 13A:
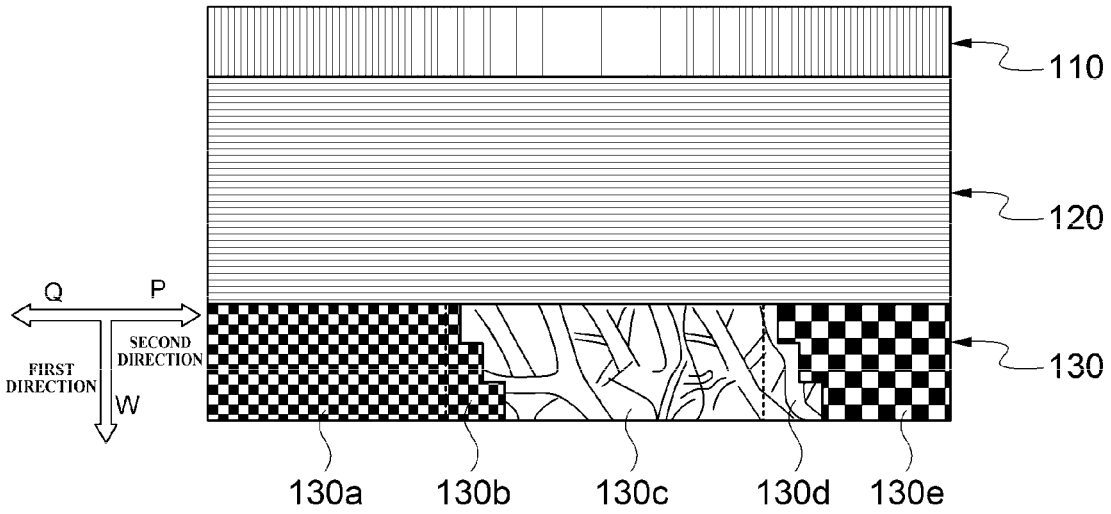
Figure 13B:
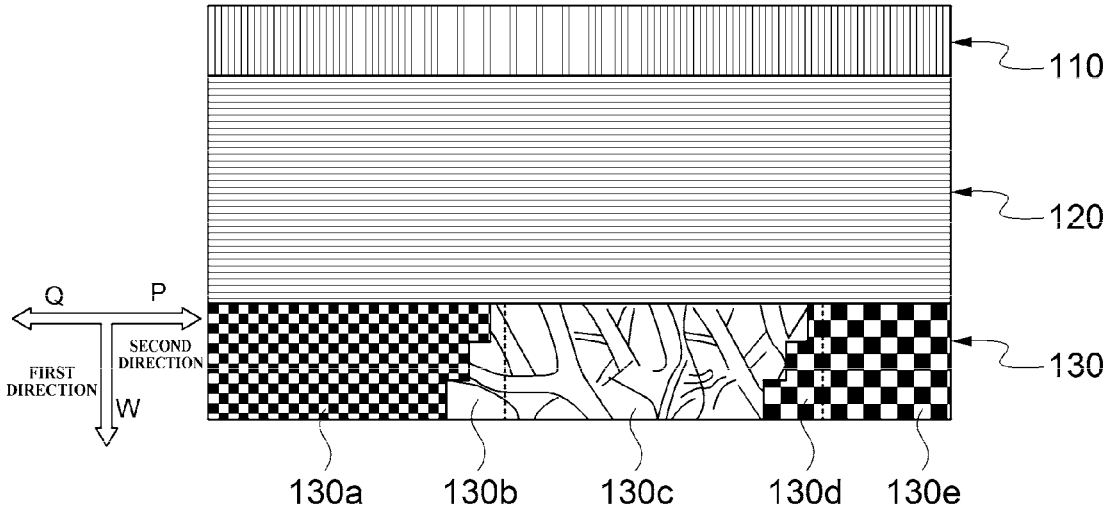
Figure 14A:
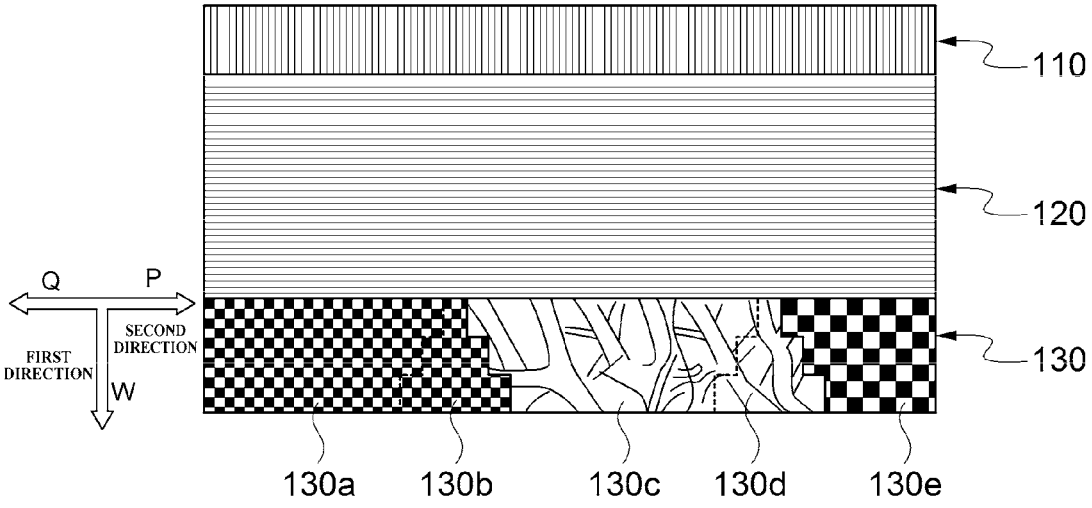
Figure 14B:
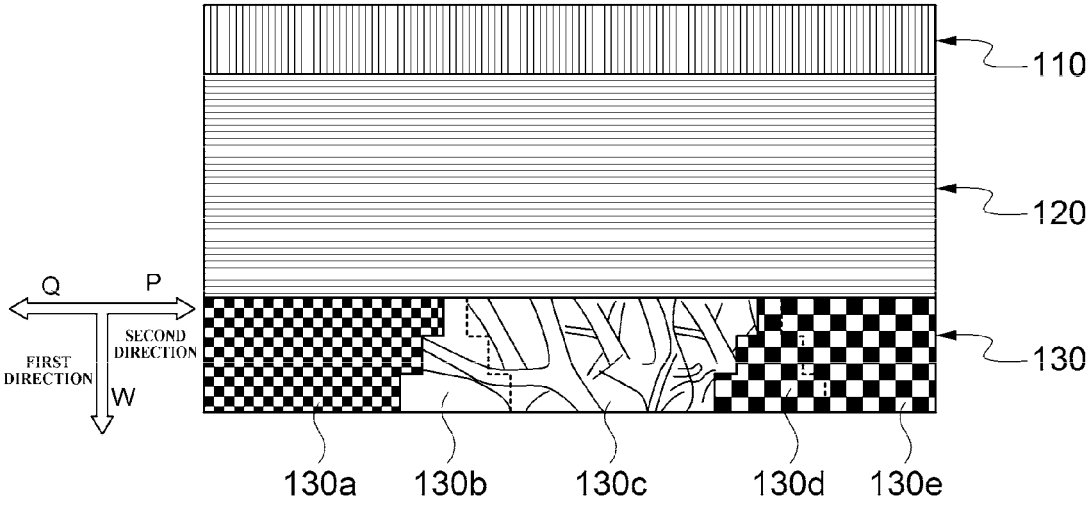

In addition, the overlapped sections 130*b* and 130*d* may be expanded non-linearly, for example with a curved type such as a parabola toward the second direction (P) while going toward the first direction (W). Here, the expansion toward to the second direction (P) may include the case of expanding toward the second direction (P) (FIGS. 11A and 11B), and a case of expanding toward to the second direction (P) as well as the opposite direction (Q) at the same time (FIGS. 12A and 12B). Accordingly, the overlapped sections 130*b* and 130*d* may be formed as shown in FIGS. 11 and 12. With this, the coupling forces of the spine sections 130*a*, 130*c* and 130*e* can be strengthened more flexibly as they go toward the first direction (W). Further, the aesthetics of the exterior of the arrow shaft can be enhanced, which may also raise demand.

Also, the overlapped sections 130*b* and 130*d* may be expanded gradationally, for example by one step or more than two steps toward the second direction (P) while going toward the first direction (W). FIGS. 13A to 14B are illustrated as the cases of expanding by two steps. Here, the expansion toward the second direction (P) includes the case of expanding toward the second direction (P), and a case of expanding toward the second direction (P) as well as the opposite direction (Q) at the same time. As such, the coupling forces of the spine sections 130*a*, 130*c* and 130*e* can be strengthened of a certainty as they go toward the first direction (W). Further, the aesthetics of the exterior of the arrow shaft may be enhanced, which may also raise demand.

The first spine section 130*a*, the second section 130*c*, and the third section 130*e* may be made from different materials and may have different lengths.

In connection with the materials, the first spine section 130*a* occupying an area A (see FIGS. 3, 4A and 4B) and the third spine section 130*e* occupying an area E may consist of a carbon fabric sheet which is woven orthogonally each other by carbon fibers. Here, the first spine section 130*a* and the third spine section 130*e* may be formed in different size numbers of fabrics. With the size numbers of fabrics, the spines of the first spine section 130*a* and the second spine section 130*c* can be adjusted. The second spine section 130*c* occupies an area C (e.g., see FIGS. 4A and 4B) of the third sheet layer 130 and may consist of a fiber sheet that is a non-elastic sheet. The fiber sheet can be prepreg treated, and can also be treated in a way such that natural or synthetic fiber is printing treated and transferring treated for a foliage pattern, camouflaged pattern such as wood grain pattern, trademark, logo or character design, etc. Areas with respect to B and D (e.g., see FIGS. 4A and 4B) of the third sheet layer 130 may be portions for the sheets forming the adjacent spine sections to be overlapped with each other.

Regarding the lengths of the first spine section 130*a*, the second spine section 130*c*, and the third spine section 130*e*, the length of the second spine section 130*c* may be the longest. Also, the length of the first spine section 130*a* may be longer than the length of the third spine section 130*e*. Here, the "length" means a length toward the second direction (P) perpendicular to the first direction (W) of the carbon fiber sheet 100 to be wound. As the length of the second spine section 130*c* becomes the longest, the strength of spine over the wide area involving the middle portion of the arrow shaft experiencing more bending due to the flight phenomenon, etc. can be the biggest. Further, as the first spine section 130*a* is formed longer than the third spine section 130*e*, the length of the first spine section 130*a* can be maintained as it is, even though the arrow shaft may be adjusted in length by partly cutting off the arrow shaft. In other words, there may be a case where a user cuts the front end of the arrow shaft depending on the conditions of use. In this regard, as the first spine section 130*a* where the front end of the arrow shaft is positioned becomes longer, the length of the first spine section 130*a* can be prevented from being shortened due to cutting by the user. In addition, as the first spine section 130*a* becomes a longer length, the center of gravity of the arrow shaft can be positioned reliably in the first spine section 130*a*. When the arrow shaft is manufactured through a process including winding the carbon fiber sheet 100, the metal arrowhead is fitted to the side of the direction (Q) of the first spine section 130*a*. Here, for example, there may be a case where the original arrowhead is replaced by another arrowhead having a different weight by a user. At this time, even though the arrowhead is replaced, the center of gravity of the arrow shaft can be positioned stably in the winding portion of the first spine section 130*a*.

The arrow shaft according to one embodiment of the present invention is formed in a way that the aforementioned carbon fiber sheet 100 is laminated on the bar-shaped metal mandrel and then is treated by the process as described above. Each of the carbon fiber sheet layers 110, 120 and 130 may be formed by a prepreg treatment for a plurality of carbon fibers or carbon fiber fabrics which are arranged in parallel along the same direction, i.e., may be formed by impregnating the carbon fibers into a resin such as an epoxy resin, a polyester resin, and a thermoplastic resin.

Here, the first sheet layer 110, the second sheet layer 120, and the third sheet layer 130 are connected to each other by adhering their boundaries. The two sheets forming the first spine section 130*a*, the second spine section 130*c*, and the third spine section 130*e* of the third sheet layer 130 are overlapped to form the first overlapped section 130*b* and the second overlapped section 130*d* so as to be adhered and connected. Accordingly, the first sheet layer 110, the second sheet layer 120 and the third sheet layer 130 are connected to each other according to one embodiment of the present invention.

As materials for the manufacturing of the arrow shaft 11, an elastic sheet, such as a carbon fiber sheet, and a non-elastic sheet in which a natural fiber or a synthetic fiber is prepreg treated, are used. In this regard, a type of the carbon fiber sheet is mainly used. There are various types of carbon fiber sheets available depending on the application, and the tensile strength, elastic coefficient, elongation, weight, and density may be different depending on the types and models of the carbon fiber sheets that currently are manufactured.

In practice, a variety of models of carbon fiber sheets ranging from general elastic sheets to very strong elastic sheets are being manufactured, and the tensile strength, elastic coefficient, elongation, extension coefficient, mass, and density per unit length are all different. However, in cases where typically the thicknesses of the carbon fiber sheets are assumed to be same, if the number of carbon fibers arranged per unit area is larger, or the weight is heavier, it can be said that the elastic strength is excellent. Further, in cases where the carbon fabrics are woven by the carbon fibers in different directions and/or cross-arrayed with each other, provides advantages in terms of excellent elastic strength and better anti-split properties compared to the carbon fabrics which consist of the carbon fibers being arranged in only one direction.

In the carbon fiber sheet 100 according to another embodiment of the present invention, the first sheet layer 110 that is the bottom layer to be attached with direct contact to the mandrel may be formed by a carbon fiber sheet with relatively low elasticity and low strength. Also, the second sheet layer 120 may be connected to the first sheet layer 110 in a way that the first sheet layer 110 and the second sheet layer 120 are formed in an orthogonal array.

The third sheet layer 130 is divided by five sections along the longitudinal direction (i.e., the second direction (P)) of the arrow shaft. Among the five sections, three spine sections 130*a*, 130*c* and 130*e* may be formed by different carbon fiber sheets, respectively. For example, the first spine section 130*a* and the third spine section 130*e* are formed by woven carbon fabrics, but the third spine section 130*e* may be adjusted in size so as to have a higher elastic strength or spine compared to the first spine section 130*a*. Further, the second spine section 130*c* may select a higher spine than those of the first spine section 130*a* and the third spine section 130*e*.

Here, the sheet forming first spine section 130*a* and the sheet forming second spine section 130*c* may be overlapped with each other in the vicinity of the boundary to form the first overlapped section 130*b*. Also, the sheet forming the second spine section 130*c* and the sheet forming the third spine section 130*e* may be overlapped with each other in the vicinity of the boundary to form the second overlapped section 130*d*.

In the third sheet layer 130 which is the outermost sheet layer among the sheet layers to be wound on the outer circumferential surface of the mandrel, the second spine section 130*c* has a stronger spine than the first spine section 130*a* and the third spine section 130*e*.

According to the embodiments of the present invention as described above, even though a flight phenomenon frequently occurs due to manufacturing errors of the arrow shaft, etc., the connections of the boundaries of the first spine section 130*a*, the second spine section 130*c* and the third spine section 130*e* are prevented from being damaged and deformed thanks to the first overlapped section 130*b* and the second overlapped section 130*d*. Further, the spine in the waist portion of the arrow shaft can be reinforced, and the arrow shaft can be prevented from being damaged and deformed due to repeated impact and flight phenomenon. In addition, the first spine section 130*a* and the third spine section 130*e* of the arrow shaft can be prevented from being damaged or deformed due to frequent shooting of the arrow. Also, the required elasticity or strength of the spine is provided with differentiated values to the arrow shaft depending on the position, thereby improving a flight stability and straightness.

Hereinafter, the process of manufacturing the arrow shaft using the aforementioned carbon fiber sheet 100 will be described.

First, a release agent is coated on the whole outer circumferential surface of the mandrel (not shown) to facilitate demolding, and then an adhesive is applied thereon. The carbon fiber sheet 100 which is cut with a predetermined length and is prepreg treated is wound on the outer circumferential surface of the mandrel, and an adhering is applied. Specifically, the first sheet layer 110 which is the end of the carbon fiber sheet 100 is adhered to the surface of the mandrel, and then the carbon fiber sheet is laminated and wound on the mandrel using a rolling machine (not shown), wherein this process may be referred to as a rolling process.

On the outermost surface of the laminate on the mandrel finished from the rolling process, a film is wound using a taping machine (not shown), wherein this process may be referred to as a taping process. For such a film, a PET film or OPP film may be used. The taping process is carried out before molding the product from the rolling process. The taping process is provided to discharge the remaining air between each sheet layer and for enhancing the internal laminating level.

Thereafter, the taped mandrel and the sheet laminate are subject to heating with varying temperatures stepwise for a predetermined time to form a molding, and then the mandrel is de-molded. In this regard, the preferred molding temperature ranges from about 80-150° C., and the heating time may be about 1-4 hours.

Finally, both end portions of the de-molded arrow shaft are cut to a required length, for example, with a length of about 825 mm, and the film is then peeled away. Then the outer circumferential surface of the arrow shaft is ground by a center-less grinding process to finish the manufacturing of the arrow shaft according to embodiments of the present invention.

Figure 15:
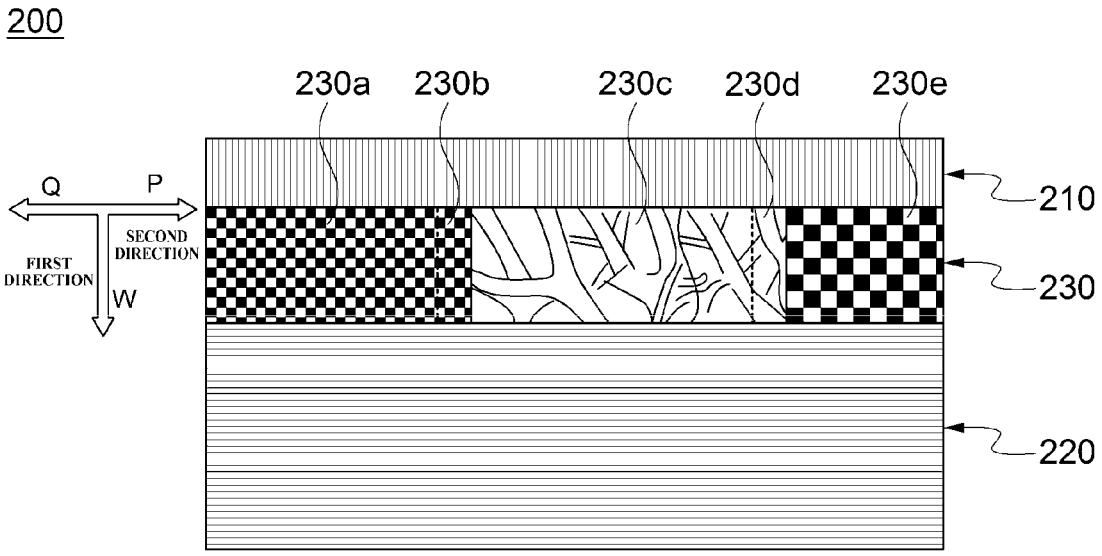
FIG. 15 is a view illustrating a carbon fiber sheet according to another embodiment of the present invention.

Hereinafter, with reference to FIG. 15, a carbon fiber sheet 200 according to another embodiment of the present invention will be described. When comparing the carbon fiber sheet 200 to the above-described carbon fiber sheet 100, the location of the third carbon fiber sheet layer differs. That is, in the carbon fiber sheet 200, the third carbon fiber sheet layer 230 is positioned between the first carbon fiber sheet layer 210 and the second carbon fiber sheet layer 220. Other configurations are the same as the previously described embodiment, and thus their description is omitted.

In the carbon fiber sheet 200, when the carbon fiber sheet 200 is wound in the first direction (W) to form the arrow shaft, the third carbon fiber sheet layer 230 is not in the outermost position. In other words, as the second carbon fiber sheet layer 220 is wound after the third carbon fiber sheet layer 230 has been wound, the spine sections 230*a*, 230*c* and 230*e* and the overlapped sections 230*b* and 230*d* are wound while covering the second carbon fiber sheet layer 220.

As described above, the second carbon fiber sheet layer 220 squeezes to cover the outer side of the third carbon fiber sheet layer 230. Thus, in the third carbon fiber sheet layer 230, the coupling forces between the first spine section 230*a*, the second spine section 230*c* and the third spine section 230*e* can be strengthened. Furthermore, as the second carbon fiber sheet layer 220 squeezes and adheres the overlapped sections 230*b* and 230*d*, the coupling forces between the first spine section 230*a*, the second spine section 230*c* and the third spine section 230*e* can be further strengthened. In addition, as the second carbon fiber sheet layer 220 integrally covers the outermost that is most deformed by the bending of the arrow shaft, and the damage to the arrow shaft caused by the bending deformations can be minimized.

The carbon fiber sheets 100 and 200 according to the embodiments of the present invention are wound to form the arrow shaft. As formed, on one side (in the direction (Q)) of the arrow shaft, an arrowhead is coupled, and on the other side (in the direction (P)), a notch is coupled to form the arrow. Further, on the outer circumferential surface around the other side of the arrow shaft, fletchings may be mounted with predetermined intervals along a circumferential direction.

As set forth above, while the present invention has been described in detail through the exemplary embodiments, it is to be understood by those skilled in the art that the exemplary embodiments may be modified without departing from the scope of the present invention.

For example, with respect to connection of the carbon fiber sheet, the arrow shaft, the arrow, and the carbon fiber sheet layer, a description has been provided wherein the carbon fiber sheet layer is positioned to be connected to the side of the first direction of the second carbon fiber sheet layer, or may be positioned to be connected to the gap between the first carbon fiber sheet layer and the second carbon fiber sheet layer. However, the present invention is not limited to thereto, and the third carbon fiber sheet layer can be positioned on the opposite side of the first direction of the first carbon fiber sheet layer.

Further, as the carbon fiber sheet is wound on the outer portion of an aluminum core, the spine and the stiffness of the arrow shaft and the arrow can be further increased, and the outermost portion of the carbon fiber sheet (i.e., the carbon fiber sheet being positioned in the end of the first direction (W)), different colors or patterns can be applied to the areas A, B, C, D and E of FIG. 4.

Therefore, the scope of the present invention is not limited to the described embodiments, and may be defined by the claims and their equivalents.

What is claimed is:

1. An arrow shaft comprising:

a carbon fiber sheet which is wound to form the arrow shaft, the carbon fiber sheet including a plurality of carbon fiber sheet layers, each of the plurality of carbon fiber sheet layers being connected to an adjacent one of the plurality of carbon fiber sheet layers along a first direction to which the carbon fiber sheet is wound to form the arrow shaft, wherein at least one of the plurality of carbon sheet layers includes three or more sheets defining five or more sections along a second direction perpendicular to the first direction, and wherein the five or more sections include three or more spine sections, and two or more overlapped sections on each of which two adjacent sheets of the three or more sheets are overlapped.

2. The arrow shaft of claim 1, wherein the carbon fiber sheet includes a first carbon fiber sheet layer, a second carbon fiber sheet layer and a third carbon fiber sheet layer along the first direction, and wherein the second carbon fiber sheet layer is the carbon fiber sheet layer including three or more sheets.

3. The arrow shaft of claim 1, wherein the second direction extends from where the arrow shaft is coupled with an arrowhead to where the arrow shaft is coupled with a notch, the carbon fiber sheet layer including three or more sheets comprises a first spine section, a first overlapped section, a second spine section, a second overlapped section and a third spine section along the second direction, and the first spine section and the third spine section are formed with woven carbon sheets.

4. The arrow shaft of claim 1, wherein one spine section among three or more spine sections being defined along the second direction is formed so as to have a higher strength than any other of the spine sections.

5. The arrow shaft of claim 1, wherein the second direction extends from where the arrow shaft is coupled with an arrowhead to where the arrow shaft is coupled with a notch, the carbon fiber sheet layer including three or more sheets includes the first spine section, the first overlapped section, the second spine section, the second overlapped section and the third spine section of which both are provided along the second direction, and an elastic strength of the second spine section is larger than those of the first spine section and the third spine section, and an area of the first and second overlapped sections are expanded as going toward the first direction.

6. The arrow shaft of claim 1, wherein the second direction extends from where the arrow shaft is coupled with an arrowhead to where the arrow shaft is coupled with a notch, the carbon fiber sheet layer including three or more sheets includes the first spine section, the first overlapped section, the second spine section, the second overlapped section and the third spine section of which both are provided along the second direction, and at least one overlapped section of the first overlapped section and the second overlapped section is formed so as to be expanded and reduced toward the second direction, while going toward the first direction.

7. The arrow shaft of claim 6, wherein at least one overlapped section of the first overlapped section and the second overlapped section is formed in a rhombic shape.

8. The arrow shaft of claim 1, wherein the second direction extends from where the arrow shaft is coupled with an arrowhead to where the arrow shaft is coupled with a notch, the carbon fiber sheet layer including three or more sheets includes the first spine section, the first overlapped section, the second spine section, the second overlapped section and the third spine section of which both are provided along the second direction, and at least one overlapped section of the first overlapped section and the second overlapped section is formed so as to be expanded and reduced repeatedly toward the second direction, while going toward the first direction.

9. The arrow shaft of claim 1, wherein the overlapped section is formed in a way that the sheet positioned on the side of the opposite direction of the second direction is positioned to be overlapped on the sheet positioned on the side of the second direction.

10. An arrow, the arrow comprising:

an arrow shaft of claim 1;

an arrowhead to be coupled to one side of the arrow shaft; and a notch to be coupled to the other side of the arrow shaft.

11. A carbon fiber sheet which is wound to form an arrow shaft, the carbon fiber sheet comprising:

a plurality of carbon fiber sheet layers, each of the plurality of carbon fiber sheet layers being connected to an adjacent one of the plurality of carbon fiber sheet layers along a first direction to which the carbon fiber sheet is wound to form the arrow shaft, wherein at least one of the plurality of carbon sheet layers includes three or more sheets defining five or more sections along a second direction perpendicular to the first direction, and wherein the five or more sections include three or more spine sections, and two or more overlapped sections on each of which two adjacent sheets of the three or more sheets are overlapped.

* * * * *